US011410628B2

(12) United States Patent
Liu et al.

(10) Patent No.: US 11,410,628 B2
(45) Date of Patent: Aug. 9, 2022

(54) PIXEL VOLTAGE COMPENSATION METHOD FOR LIQUID CRYSTAL DISPLAY TO SUPPRESS PIXEL ELECTRODE VOLTAGE CROSS-TALK

(71) Applicant: BOE TECHNOLOGY GROUP CO., LTD., Beijing (CN)

(72) Inventors: Liwei Liu, Beijing (CN); Yun Sik Im, Beijing (CN); Yoon Sung Um, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 629 days.

(21) Appl. No.: 16/325,082

(22) PCT Filed: May 4, 2018

(86) PCT No.: PCT/CN2018/085615

§ 371 (c)(1),
(2) Date: Feb. 12, 2019

(87) PCT Pub. No.: WO2019/024557

PCT Pub. Date: Feb. 7, 2019

(65) Prior Publication Data

US 2021/0287622 A1 Sep. 16, 2021

(30) Foreign Application Priority Data

Jul. 31, 2017 (CN) ..... 201710637613.X

(51) Int. Cl.
*G09G 3/36* (2006.01)

(52) U.S. Cl.
CPC ..... *G09G 3/3696* (2013.01); *G09G 3/3688* (2013.01); *G09G 2320/0209* (2013.01)

(58) Field of Classification Search
CPC ..... G09G 3/36; G09G 3/3611; G09G 3/3614; G09G 3/364; G09G 3/3677; G09G 3/3681;
(Continued)

(56) References Cited

U.S. PATENT DOCUMENTS 5,432,527 A 7/1995 Yanai et al.
5,798,740 A 8/1998 Bitzakidis et al.
(Continued)

FOREIGN PATENT DOCUMENTS

CN 101320170 A 12/2008
CN 103257498 A 8/2013
(Continued)

OTHER PUBLICATIONS

International Search Report of PCT/CN2018/085615 in Chinese, dated Aug. 10, 2018, with English translation.
(Continued)

*Primary Examiner* — Alexander Eisen
*Assistant Examiner* — Nelson Lam
(74) *Attorney, Agent, or Firm* — Collard & Roe, P.C.

(57) ABSTRACT

A pixel voltage compensation method, a pixel voltage compensator device and a display device are provided. The compensation method includes: determining a capacitance between at least one data line adjacent to a target pixel electrode and the target pixel electrode; detecting a voltage difference between a driving voltage of the data line and a driving voltage of the target pixel electrode in a period from a start of present charging of the target pixel electrode to a start of next charging; calculating a variation of the driving voltage of the target pixel electrode caused by the capacitance and the voltage difference; and compensating for the driving voltage of the target pixel electrode according to the variation. This compensation method can suppress the phe-
(Continued)

nomenon of voltage cross-talk, and thus can improve the display effect of the display device.

13 Claims, 5 Drawing Sheets

(58) Field of Classification Search
CPC .. G09G 3/3685; G09G 3/3688; G09G 3/3692; G09G 3/3696
USPC ..... 345/87–104
See application file for complete search history.

(56) References Cited

U.S. PATENT DOCUMENTS

| | | | | |
|---|---|---|---|---|
| 2008/0303967 | A1 | 12/2008 | Huang et al. | |
| 2009/0244109 | A1* | 10/2009 | Chen | G09G 3/3648 345/690 |
| 2012/0169706 | A1* | 7/2012 | Dong | G09G 3/3677 345/212 |
| 2012/0249620 | A1* | 10/2012 | Choi | G09G 3/3688 345/694 |
| 2014/0125571 | A1* | 5/2014 | Um | G09G 3/3614 345/88 |
| 2015/0061987 | A1* | 3/2015 | Jung | G09G 3/3696 345/100 |
| 2015/0070613 | A1 | 3/2015 | Dong | |
| 2015/0177582 | A1 | 6/2015 | Lai et al. | |
| 2015/0235625 | A1* | 8/2015 | Chen | G09G 3/3614 345/205 |
| 2016/0071493 | A1 | 3/2016 | Yoshiga | |
| 2016/0240128 | A1* | 8/2016 | Kim | G09G 3/3233 |
| 2020/0251030 | A1* | 8/2020 | Kim | G09G 3/3648 |

FOREIGN PATENT DOCUMENTS

| | | | |
|---|---|---|---|
| CN | 103454823 | A | 12/2013 |
| CN | 103926776 | A | 7/2014 |
| CN | 105405415 | A | 3/2016 |
| CN | 107195280 | A | 9/2017 |
| EP | 0 373 565 | A2 | 6/1990 |
| EP | 1 049 955 | B1 | 1/2008 |
| JP | 2006119450 | A | 5/2006 |
| WO | 94/08331 | A1 | 4/1994 |

OTHER PUBLICATIONS

Notice of Transmittal of the International Search Report of PCT/CN2018/085615 in Chinese, dated Aug. 10, 2018.
Written Opinion of the International Searching Authority of PCT/CN2018/085615 in Chinese, dated Aug. 10, 2018 with English translation.
Chinese Office Action in Chinese Application No. 201710637613.X, dated Mar. 4, 2019 with English translation.

* cited by examiner

PIXEL VOLTAGE COMPENSATION METHOD FOR LIQUID CRYSTAL DISPLAY TO SUPPRESS PIXEL ELECTRODE VOLTAGE CROSS-TALK

CROSS REFERENCE TO RELATED APPLICATIONS

This application is the National Stage of PCT/CN2018/085615 filed on May 4, 2018, which claims priority under 35 U.S.C. § 119 of Chinese Application No. 201710637613.X filed on Jul. 31, 2017, the disclosure of which is incorporated by reference.

TECHNICAL FIELD

Embodiments of the present disclosure relate to a pixel voltage compensation method, a pixel voltage compensator device and a display device.

BACKGROUND

Liquid crystal display panels are widely used in people's daily life due to advantages such as small size and light weight. A conventional liquid crystal display panel includes data lines and gate lines that intersect each other. The data lines and the gate lines define a plurality of pixel regions in which pixel electrodes and switch transistors are respectively disposed. During display, the gate lines are applied with scan signals one by one, the switch transistors connected with the gate lines which are applied with the scan signals are correspondingly turned on, and the data lines are applied with data signals simultaneously or column by column to drive the pixel electrodes to display row by row.

SUMMARY

Embodiments of the present disclosure provide a pixel voltage compensation method, and the pixel voltage compensation method includes: determining a capacitance between at least one data line adjacent to a target pixel electrode and the target pixel electrode; detecting a voltage difference between a driving voltage of the data line and a driving voltage of the target pixel electrode in a period from a start of present charging of the target pixel electrode to a start of next charging of the target pixel electrode; calculating a variation of the driving voltage of the target pixel electrode caused by the capacitance and the voltage difference; and compensating for the driving voltage of the target pixel electrode according to the variation.

For example, in the pixel voltage compensation method provided by the embodiments of the present disclosure, the at least one data line adjacent to the target pixel electrode includes a first data line, and the first data line is connected through switch elements with the target pixel electrode and with other first pixel electrodes which are in a column provided with the target pixel electrode. The pixel voltage compensation method includes: determining a first capacitance between the first data line and the target pixel electrode; detecting a first voltage difference between a driving voltage applied to each of the first pixel electrodes by the first data line and a driving voltage applied to the target pixel electrode by the first data line, in the period from the start of the present charging of the target pixel electrode to the start of the next charging of the target pixel electrode; calculating the variation of the driving voltage of the target pixel electrode caused by the first capacitance and the first voltage difference; and compensating for the driving voltage of the target pixel electrode according to the variation.

For example, in the pixel voltage compensation method provided by the embodiments of the present disclosure, in the period from the start of the present charging of the target pixel electrode to the start of the next charging of the target pixel electrode, the first data line drives n−1 first pixel electrodes, in which n>1, and n is an integer; the variation ΔV of the driving voltage of the target pixel electrode caused by the first capacitance and the first voltage difference is calculated by a following expression: $\Delta V=\{Cdp1*[\Delta V11*T11+\Delta V12*T12+\ldots+\Delta V1(n-1)*T1(n-1)]/Ts\}/Cpixel$; in which Cdp1 is the first capacitance; ΔV1(n−1) is a first voltage difference between a driving voltage applied to an (n−1)th first pixel electrode by the first data line and the driving voltage applied to the target pixel electrode by the first data line; T1(n−1) is driving time of the (n−1)th first pixel electrode; Ts is time of one frame of displayed image; Cpixel is a total capacitance of the target pixel electrode.

For example, in the pixel voltage compensation method provided by the embodiments of the present disclosure, the at least one data line adjacent to the target pixel electrode includes a second data line, the second data line is connected with a column of second pixel electrodes through switch elements, and the column of the second pixel electrodes is adjacent to a column provided with the target pixel electrode. The pixel voltage compensation method includes: determining a second capacitance between the second data line and the target pixel electrode; detecting a second voltage difference between a driving voltage applied to each of the second pixel electrodes by the second data line and the driving voltage of the target pixel electrode in the period from the start of the present charging of the target pixel electrode to the start of the next charging of the target pixel electrode; calculating the variation of the driving voltage of the target pixel electrode caused by the second capacitance and the second voltage difference; and compensating for the driving voltage of the target pixel electrode according to the variation.

For example, in the pixel voltage compensation method provided by the embodiments of the present disclosure, the second data line drives n second pixel electrodes in the period from the start of the present charging of the target pixel electrode to the start of the next charging of the target pixel electrode, in which n>1 and n is an integer; the variation ΔV of the driving voltage of the target pixel electrode caused by the second capacitance and the second voltage difference is calculated by a following expression: $\Delta V=\{Cdp2*[\Delta V21*T21+\Delta V22*T22+\ldots+\Delta V2(n-1)*T2(n-1)+\Delta V2n*T2n]/Ts\}/Cpixel$; in which Cdp2 is the second capacitance; ΔV2n is a second voltage difference between a driving voltage applied to a nth second pixel electrode by the second data line and the driving voltage of the target pixel electrode; T2n is driving time of the nth second pixel electrode; Ts is time of one frame of displayed image; Cpixel is a total capacitance of the target pixel electrode.

For example, in the pixel voltage compensation method provided by the embodiments of the present disclosure, the at least one data line adjacent to the target pixel electrode includes a first data line and a second data line, the first data line is connected through switch elements with the target pixel electrode and with other first pixel electrodes which are in a column provided with the target pixel electrode; the second data line is connected with a column of second pixel electrodes through switch elements, and the column of the second pixel electrodes is adjacent to the column provided with the target pixel electrode. The pixel voltage compensation method includes: determining a first capacitance between the first data line and the target pixel electrode, and determining a second capacitance between the second data line and the target pixel electrode; in the period from the start of the present charging of the target pixel electrode to the start of the next charging of the target pixel electrode, detecting a first voltage difference between a driving voltage applied to each of the first pixel electrodes by the first data line and a driving voltage applied to the target pixel electrode by the first data line, and detecting a second voltage difference between a driving voltage applied to each of the second pixel electrodes by the second data line and the driving voltage applied to the target pixel electrode by the first data line; calculating the variation of the driving voltage of the target pixel electrode caused by the first capacitance, the second capacitance, the first voltage difference and the second voltage difference; and compensating for the driving voltage of the target pixel electrode according to the variation.

For example, in the pixel voltage compensation method provided by the embodiments of the present disclosure, in the period from the start of the present charging of the target pixel electrode to the start of the next charging of the target pixel electrode, the first data line drives n−1 first pixel electrodes, the second data line drives n second pixel electrodes, in which n>1, and n is an integer; the variation ΔV of the driving voltage of the target pixel electrode caused by the first capacitance, the second capacitance, the first voltage difference and the second voltage difference is calculated by a following expression: $\Delta V=\{Cdp1*[\Delta V11*T11+\Delta V12*T12+\ldots+\Delta V1(n-1)*T1(n-1)]/Ts+Cdp2*[\Delta V21*T21+\Delta V22*T22+\ldots+\Delta V2(n-1)*T2(n-1)+\Delta V2n*T2n]/Ts\}/Cpixel$, in which Cdp1 is the first capacitance; Cdp2 is the second capacitance; ΔV1(n−1) is a first voltage difference between a driving voltage applied to an (n−1)th first pixel electrode by the first data line and the driving voltage applied to the target pixel electrode by the first data line; ΔV2n is a second voltage difference between a driving voltage applied to a nth second pixel electrode by the second data line and the driving voltage applied to the target pixel electrode by the first data line; T1(n−1) is driving time of the (n−1)th first pixel electrode; T2n is driving time of the nth second pixel electrode; Ts is time of one frame of displayed image; Cpixel is a total capacitance of the target pixel electrode.

For example, in the pixel voltage compensation method provided by the embodiments of the present disclosure, the compensating for the driving voltage of the target pixel electrode according to the variation includes: determining whether the variation is greater than zero or less than zero; in a case where the variation is greater than zero, subtracting the variation from the driving voltage of the target pixel electrode; in a case where the variation is less than zero, adding an absolute value of the variation to the driving voltage of the target pixel electrode.

For example, in the pixel voltage compensation method provided by the embodiments of the present disclosure, the total capacitance of the target pixel electrode is a storage capacitance of the target pixel electrode.

For example, in the pixel voltage compensation method provided by the embodiments of the present disclosure, the pixel voltage adopts an inversion manner of column inversion or an inversion manner of dot inversion during displaying one frame of images.

The embodiments of the present disclosure provides another pixel voltage compensation method, and the pixel voltage compensation method includes: obtaining a first voltage difference between a driving voltage, in a charging period of a target pixel electrode, of a first data line connected with the target pixel electrode and a driving voltage of the target pixel electrode, in which the charging period of the target pixel electrode is a period of time from a start of present charging of the target pixel electrode to a start of next charging of the target pixel electrode; calculating a first variation of the driving voltage of the target pixel electrode caused by the first voltage difference and a first capacitance, in which the first capacitance is a capacitance between the target pixel electrode and the first data line; and compensating for the driving voltage of the target pixel electrode at least according to the first variation.

For example, the another pixel voltage compensation method provided by the embodiments of the present disclosure further includes: obtaining a second voltage difference between a driving voltage, in the charging period, of a second data line adjacent to the target pixel electrode and an initial driving voltage of the second data line at an initial moment of the charging period, in which the first data line and the second data line are on opposite sides of the target pixel electrode; calculating a second variation of the driving voltage of the target pixel electrode caused by the second voltage difference and a second capacitance, in which the second capacitance is a capacitance between the target pixel electrode and the second data line; and compensating for the driving voltage of the target pixel electrode according to at least the first variation and the second variation.

For example, the another pixel voltage compensation method provided by the embodiments of the present disclosure, in the charging period of the target pixel electrode, the first data line drives the target pixel electrode and n−1 first pixel electrodes, and the second data line drives n second pixel electrodes, in which n>1, and n is an integer; a variation of the driving voltage of the target pixel electrode caused by the first capacitance, the second capacitance, the first voltage difference and the second voltage difference is calculated by a following expression: $\Delta V=\{Cdp1*[V11*T11+\Delta V12*T12+\ldots+\Delta V1(n-1)*T1(n-1)]/Ts+Cdp2*[\Delta V21*T21+\Delta V22*T22+\ldots+\Delta V2(n-1)*T2(n-1)+\Delta V2n*T2n]/Ts\}/Cpixel$; in which Cdp1 is the first capacitance; Cdp2 is the second capacitance; ΔV1(n−1) is a first voltage difference between a driving voltage applied to an (n−1)th first pixel electrode by the first data line and a driving voltage applied to the target pixel electrode by the first data line; ΔV2n is a second voltage difference between a driving voltage applied to a nth second pixel electrode by the second data line and the initial driving voltage; T1(n−1) is driving time of the (n−1)th first pixel electrode; T2n is driving time of the nth second pixel electrode; Ts is time of one frame of displayed image; Cpixel is a total capacitance of the target pixel electrode.

For example, the another pixel voltage compensation method provided by the embodiments of the present disclosure further includes: determining the first capacitance between the target pixel electrode and the first data line, and determining the second capacitance between the target pixel electrode and the second data line.

The embodiments of the present disclosure further provide a pixel voltage compensator device which includes a determination module, a detector module, a calculator module and a compensator module. The determination module is configured to determine a capacitance between at least one data line adjacent to a target pixel electrode and the target pixel electrode; the detector module is configured to detect a voltage difference between a driving voltage of the data line and a driving voltage of the target pixel electrode in a period from a start of present charging of the target pixel electrode to a start of next charging of the target pixel electrode; the calculator module is configured to calculate a variation of the driving voltage of the target pixel electrode caused by the capacitance and the voltage difference; the compensator module is configured to compensate for the driving voltage of the target pixel electrode according to the variation.

For example, in the pixel voltage compensator device provided by the embodiments of the present disclosure, the at least one data line adjacent to the target pixel electrode includes a first data line, and the first data line is connected through switch elements with the target pixel electrode and with other first pixel electrodes which are in a column provided with the target pixel electrode; the determination module is configured to determine a first capacitance between the first data line and the target pixel electrode; the detector module is configured to detect a first voltage difference between a driving voltage applied to each of the first pixel electrodes by the first data line and a driving voltage applied to the target pixel electrode by the first data line, in the period from the start of the present charging of the target pixel electrode to the start of the next charging of the target pixel electrode; the calculator module is configured to calculate the variation of the driving voltage of the target pixel electrode caused by the first capacitance and the first voltage difference.

For example, in the pixel voltage compensator device provided by the embodiments of the present disclosure, the at least one data line adjacent to the target pixel electrode includes a second data line, the second data line is connected with a column of second pixel electrodes through switch elements, and the column of the second pixel electrodes is adjacent to a column provided with the target pixel electrode; the determination module is configured to determine a second capacitance between the second data line and the target pixel electrode; the detector module is configured to detect a second voltage difference between a driving voltage applied to each of the second pixel electrodes by the second data line and the driving voltage of the target pixel electrode, in the period from the start of the present charging of the target pixel electrode to the start of the next charging of the target pixel electrode; the calculator module is configured to calculate the variation of the driving voltage of the target pixel electrode caused by the second capacitance and the second voltage difference.

For example, in the pixel voltage compensator device provided by the embodiments of the present disclosure, the at least one data line adjacent to the target pixel electrode includes a first data line and a second data line, the first data line is connected through switch elements with the target pixel electrode and with other first pixel electrodes in a column provided with the target pixel electrode, the second data line is connected with a column of second pixel electrodes through switch elements, and the column of the second pixel electrodes is adjacent to the column provided with the target pixel electrode; the determination module is configured to determine a first capacitance between the first data line and the target pixel electrode, and to determine a second capacitance between the second data line and the target pixel electrode; the detector module is configured to detect a first voltage difference between a driving voltage applied to each of the first pixel electrodes by the first data line and a driving voltage applied to the target pixel electrode by the first data line, and to detect a second voltage difference between a driving voltage applied to each of the second pixel electrodes by the second data line and the driving voltage applied to the target pixel electrode by the first data line, in the period from the start of the present charging of the target pixel electrode to the start of the next charging of the target pixel electrode; the calculator module is configured to calculate the variation of the driving voltage of the target pixel electrode caused by the first capacitance, the second capacitance, the first voltage difference and the second voltage difference.

For example, in the pixel voltage compensator device provided by the embodiments of the present disclosure, the compensator module includes a judgment unit, a first compensator unit and a second compensator unit; the judgment unit is configured to determine whether the variation is greater than zero or less than zero; the first compensator unit is configured to subtract the variation from the driving voltage of the target pixel electrode in a case where a determination result of the judgment unit is that the variation is greater than zero; the second compensator unit is configured to add an absolute value of the variation to the driving voltage of the target pixel electrode in a case where the determination result of the judgment unit is that the variation is less than zero.

The embodiments of the present disclosure further provide another pixel voltage compensator device which includes a processor and a memory, the memory stores a computer program instruction that is executed by the processor to perform a following method comprising: obtaining a first voltage difference between a driving voltage, in a charging period of a target pixel electrode, of a first data line connected with the target pixel electrode and a driving voltage of the target pixel electrode, in which the charging period of the target pixel electrode is a period of time from a start of present charging of the target pixel electrode to a start of next charging of the target pixel electrode; calculating a first variation of the driving voltage of the target pixel electrode caused by the first voltage difference and a first capacitance, in which the first capacitance is a capacitance between the target pixel electrode and the first data line; compensating for the driving voltage of the target pixel electrode at least according to the first variation.

For example, in the another pixel voltage compensator device provided by the embodiments of the present disclosure, the computer program instruction is executed by the processor to further perform a following method comprising: obtaining a second voltage difference between a driving voltage, in the charging period, of a second data line adjacent to the target pixel electrode and an initial driving voltage of the second data line at an initial moment of the charging period, in which the first data line and the second data line are on opposite sides of the target pixel electrode; calculating a second variation of the driving voltage of the target pixel electrode caused by the second voltage difference and a second capacitance, in which the second capacitance is a capacitance between the target pixel electrode and the second data line; and compensating for the driving voltage of the target pixel electrode according to at least the first variation and the second variation.

The embodiments of the present disclosure further provide still another pixel voltage compensator device which includes a detector module, a calculator module and a compensator module. The detector module is configured to obtain a first voltage difference between a driving voltage, in a charging period of a target pixel electrode, of a first data line adjacent to the target pixel electrode and a driving voltage of the target pixel electrode, and to obtain a second voltage difference between a driving voltage, in the charging period, of a second data line adjacent to the target pixel electrode and an initial driving voltage of the second data line at an initial moment of the charging period, in which the charging period of the target pixel electrode is time of period from a start of present charging of the target pixel electrode to a start of next charging of the target pixel electrode, and the first data line and the second data line are on opposite sides of the target pixel electrode. The calculator module is configured to calculate a first variation of the driving voltage of the target pixel electrode caused by the first voltage difference and a first capacitance, and to calculate a second variation of the driving voltage of the target pixel electrode caused by the second voltage difference and a second capacitance, in which the first capacitance is a capacitance between the target pixel electrode and the first data line, and the second capacitance is a capacitance between the target pixel electrode and the second data line. The compensator module is configured to compensate for the driving voltage of the target pixel electrode according to at least the first variation and the second variation.

For example, the still another pixel voltage compensator device provided by the embodiments of the present disclosure further includes a determination module, and the determination module is configured to determine the first capacitance between the target pixel electrode and the first data line, and to determine the second capacitance between the target pixel electrode and the second data line.

The embodiments of the present disclosure further provide still another pixel voltage compensator device which includes a processor and a memory, the memory stores a computer program instruction, and the computer program instruction is executed by the processor to perform a following method comprising: determining a capacitance between at least one data line adjacent to a target pixel electrode and the target pixel electrode; detecting a voltage difference between a driving voltage of the data line and a driving voltage of the target pixel electrode in a period from a start of present charging of the target pixel electrode to a start of next charging of the target pixel electrode; calculating a variation of the driving voltage of the target pixel electrode caused by the capacitance and the voltage difference; and compensating for the driving voltage of the target pixel electrode according to the variation.

The embodiments of the present disclosure further provide a display device which includes the pixel voltage compensator device according to any one of the above embodiments and a display panel.

BRIEF DESCRIPTION OF THE DRAWINGS

In order to clearly illustrate the technical solution of the embodiments of the disclosure, the drawings of the embodiments or related art will be briefly described in the following; it is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

The inventors of the present disclosure have noticed that current display devices (for example, liquid crystal display devices) have a voltage cross-talk phenomenon, especially for dot inversion type liquid crystal display devices or column inversion type liquid crystal display devices. Exemplary descriptions will be made below in conjunction with FIG. 1.

Figure 1:
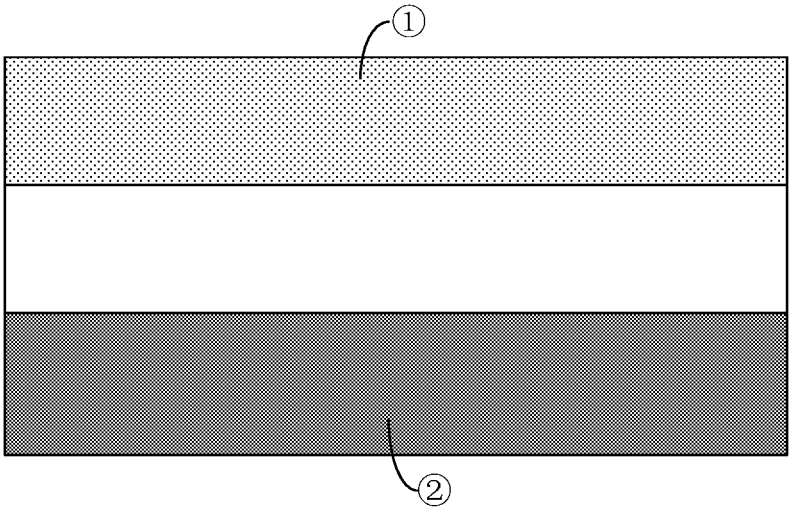
FIG. 1 is a schematic diagram illustrating a cross-talk phenomenon in a displayed image.

After a liquid crystal display panel is manufactured, there is a certain capacitance between a pixel electrode and a data line adjacent to the pixel electrode, and the value of the capacitance is related to a specific manufacturing process; meanwhile, in a driving process of the pixel electrode, values of driving voltages that the data line applies to different pixel electrodes are usually different. For a certain pixel electrode, its driving voltage is usually affected by driving voltages applied to other pixel electrodes by the data line adjacent to the certain pixel electrode. The capacitance which exists between the pixel electrode and the data line adjacent to the pixel electrode and the driving voltages of the data line adjacent to the pixel electrode affect the driving voltage of the pixel electrode, and cause an apparent difference between actual displayed brightness of different pixel electrodes of the display panel in the case where the image pixels, to be displayed by the different pixel electrodes, of a display image have a same gray scale, and thus resulting in the cross-talk phenomenon on the overall displayed image or a display device. As illustrated in FIG. 1, the pixel electrode in a region ① and the pixel electrode in a region ② which are on the display panel are both applied with a pixel voltage for displaying a gray scale of 127, however, for the actual displayed brightness of the pixel electrodes in the above two regions, the displayed brightness of the pixel electrode in the region ① is greater than the displayed brightness of the gray scale of 127 (namely, the displayed brightness of the pixel electrode in the region ① is brighter), and the displayed brightness of the pixel electrode in the region ② is less than the displayed brightness of the gray scale of 127 (namely, the displayed brightness of the pixel electrode in the region ② is darker), this seriously affects the display effect of the displayed image. Therefore, it is desired to suppress the cross-talk phenomenon that occurs during the display of the liquid crystal display panel.

Embodiments of the present disclosure provide a pixel voltage compensation method, a pixel voltage compensator device and a display device. The pixel voltage compensation method, the pixel voltage compensator device and the display device can suppress the voltage cross-talk phenomenon.

In order to enable those skilled in the art to better understand the technical solutions provided by the embodiments of the present disclosure, the pixel voltage compensation method, the pixel voltage compensator device and the display device according to the embodiments of the present disclosure are described in an unrestricted way with reference to several examples below. In case of no conflict, the features in the specific examples as described below may be combined with each other to obtain new examples, all of which are also within the scope of the present disclosure.

Figure 2:
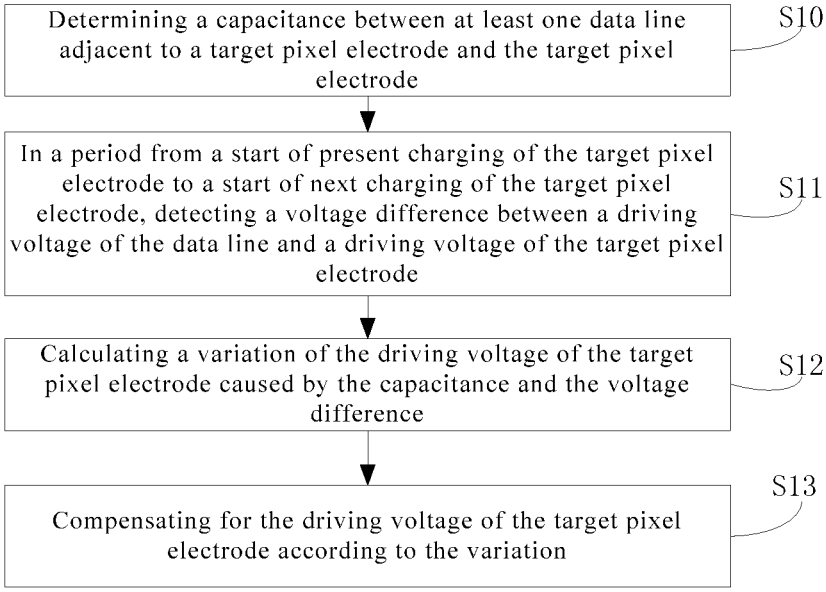
FIG. 2 is a flowchart of a pixel voltage compensation method according to an embodiment of the present disclosure.

At least one embodiment of the present disclosure provides a pixel voltage compensation method. As illustrated in FIG. 2, the pixel voltage compensation method includes the following steps.

Step S10: determining a capacitance between at least one data line adjacent to a target pixel electrode and the target pixel electrode.

Step S11: detecting a voltage difference between a driving voltage of the data line and a driving voltage of the target pixel electrode in a period from a start of present charging of the target pixel electrode to a start of next charging of the target pixel electrode (that is, in a charging period of the target pixel electrode).

In the embodiment of the present disclosure, the compensation for the pixel voltage of the target pixel electrode mainly involves to take the following influences into consideration: the influences that the capacitance and the voltage difference have on the pixel voltage of the target pixel electrode in one frame of displayed image period.

Step S12: calculating a variation of the driving voltage of the target pixel electrode caused by the capacitance and the voltage difference.

It should be noted that the above capacitance is determined by a manufacturing process of an array substrate. After the array substrate is manufactured, the value of the capacitance between the data line adjacent to the target pixel electrode and the target pixel electrode is determined accordingly. Therefore, in other examples, the pixel voltage compensation method may not include the step S10, and the capacitance between the at least one data line and the target pixel electrode may be obtained by detection after the array substrate is manufactured and may be used in the pixel voltage compensation method. Therefore, in the other examples, in performing the pixel voltage compensation method, there is no need to determine the capacitance between each target pixel electrode and at least one data line (e.g., a first data line connected with the target pixel electrode and a second data line adjacent to the target pixel electrode) adjacent to the each target pixel electrode (for example, the capacitance between each target pixel electrode and at least one data line adjacent to the each target pixel electrode includes a first capacitance between the target pixel electrode and the first data line and a second capacitance between the target pixel electrode and the second data line). It should be noted that, in other examples of the pixel voltage compensation method, the step of determining the capacitance may not be included.

Step S13: compensating for the driving voltage of the target pixel electrode according to the variation.

Figure 3:
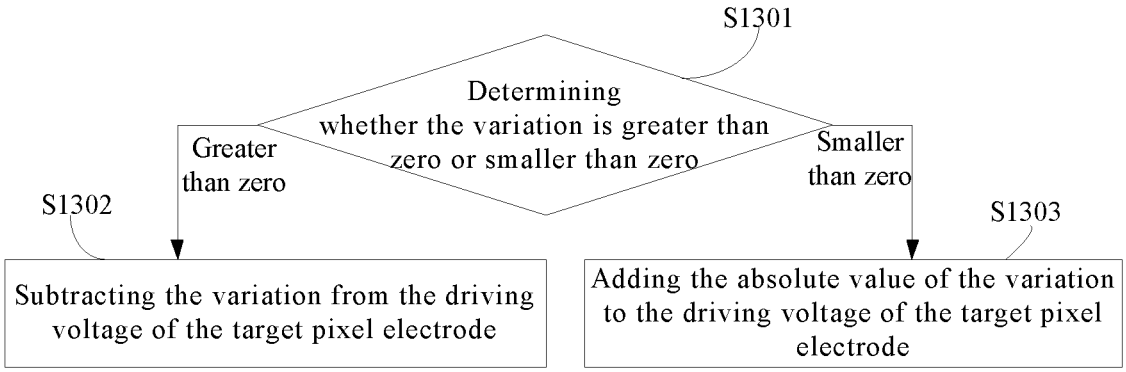
FIG. 3 is a flowchart of compensating for a driving voltage of a target pixel electrode according to a variation, in an embodiment of the present disclosure.

As illustrated in FIG. 3, the compensating for the driving voltage of the target pixel electrode according to the variation may include the following steps.

Step S1301: determining whether the variation is greater than zero or less than zero.

In the case where the variation is greater than zero, step S1302 is performed, that is: the variation is subtracted from the driving voltage of the target pixel electrode.

In the case where the variation is less than zero, step S1303 is performed, that is: the absolute value of the variation is added to the driving voltage of the target pixel electrode.

By performing the step S1301 to the step S1303, the driving voltage of the target pixel electrode can be compensated, and a compensation amount for the driving voltage of the target pixel electrode may be just equal to the amount of influence that the capacitance between the at least one data line adjacent to the target pixel electrode and the target pixel electrode and the voltage difference between the driving voltage of the data line and the driving voltage of the target pixel electrode have on the driving voltage of the target pixel electrode.

For example, in the embodiments of the present disclosure, each pixel electrode on the display panel may separately serve as the target pixel electrode, then the above-described pixel voltage compensation method is performed for each pixel electrode, and the variation of the driving voltage of each pixel electrode caused by the capacitance and the voltage difference is obtained, this can realize the pixel voltage compensation for each pixel electrode, thus suppress the difference between actual displayed brightness of different pixel electrodes having the same display gray scale in displaying an image, and suppress the cross-talk phenomenon of the displayed image.

It should be noted that the charging periods of different pixel electrodes (the charging period of one pixel electrode is the period from the start of the present charging of the pixel electrode to the start of the next charging of the pixel electrode) do not completely overlap in time.

It should be noted that the time when the step S11, the step S12 and the step S13 are performed may be set according to actual application requirements, and the time is not limited in the embodiments of the present disclosure. For example, in one example, the step S11, the step S12 and the step S13 may be performed within a blanking time between adjacent display frames, and then a compensated driving voltage is applied to each pixel electrode on the display panel in a subsequent display period, to drive each display pixel to emit light. For example, in another example, after a source of images is obtained and before the images are displayed, for each frame of the images, each pixel electrode included in the display panel is subjected to the step S11, the step S12 and the step S13; then, the compensated driving voltage of each pixel electrode in each frame of images is obtained in advance before the images are displayed; and afterwards, in displaying a plurality of frames of the images, the compensated driving voltages are applied to corresponding pixel electrodes of the display panel to drive the display pixels to emit light.

In the embodiments of the present disclosure, during a display period of any one frame of the images, the driving voltage may be inversed in an inversion manner of column inversion or an inversion manner of dot inversion. In the case where a driving manner of column inversion or a driving manner of dot inversion is employed, the pixel voltage difference between the pixel electrodes in adjacent columns is large or the pixel voltage difference between any pixel electrode and any adjacent pixel electrode that is adjacent to the any pixel electrode is large, and thus the voltage difference between the driving voltage of the data line and the driving voltage of the target pixel electrode is large, whereby the variation of the driving voltage of the target pixel caused by the capacitance between at least one data line adjacent to the target pixel electrode and the target pixel electrode as well as the voltage difference between the driving voltage of the data line and the driving voltage of the target pixel electrode is large, and thus a large difference occurs between the actual displayed brightness of different pixels displaying the same gray level in the displayed image, that is, a relatively serious cross-talk phenomenon occurs in the displayed image. Therefore, the pixel voltage compensation method in the embodiments of the present disclosure is particularly suitable for suppressing the cross-talk phenomenon of the display device employing the driving manner of column inversion or the driving manner of dot inversion.

For example, in one example, in the pixel voltage compensation method provided by the embodiments of the present disclosure, by detecting and determining the capacitance that is between the at least one data line adjacent to the target pixel electrode and the target pixel electrode and that causes the variation of the driving voltage of the target pixel electrode, and by detecting and determining the voltage difference between the driving voltage of the data line and the driving voltage of the target pixel electrode, the variation of the driving voltage of the target pixel electrode is calculated according to these influencing factors; and then the driving voltage of the target pixel electrode is compensated according to the variation, so as to suppress the difference between the actual displayed brightness of different pixels displaying the same gray level, thereby suppressing the cross-talk phenomenon of the display device and improving the display effect of the display device.

For example, in another example, in the pixel voltage compensation method provided by the embodiments of the present disclosure, the voltage difference between the driving voltage of the data line and the driving voltage of the target pixel electrode may be obtained, the variation of the driving voltage of the target pixel electrode may be calculated according to the above voltage difference and the capacitance between the at least one data line adjacent to the target pixel electrode and the target pixel electrode, and then the driving voltage of the target pixel electrode is compensated according to the variation to improve the display effect of the display device.

Figure 4:
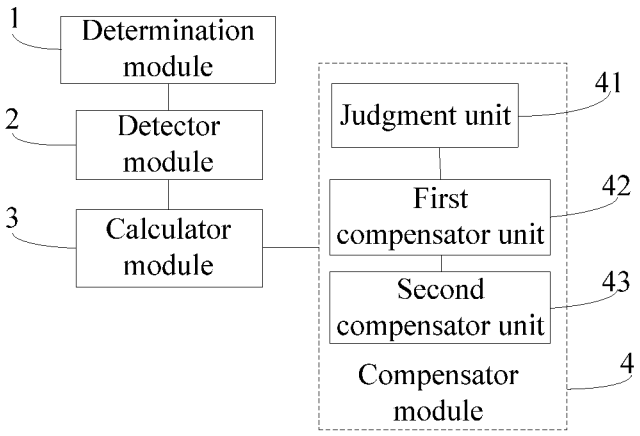
FIG. 4 is an exemplary block diagram of a pixel voltage compensator device according to an embodiment of the present disclosure.

Based on the pixel voltage compensation method provided by the embodiments of the present disclosure, the embodiments of the present disclosure further provide a pixel voltage compensator device. As illustrated in FIG. 4, the pixel voltage compensator device includes: a determination module 1, a detector module 2, a calculator module 3 and a compensator module 4. The determination module 1 is configured to determine the capacitance between the at least one data line adjacent to the target pixel electrode and the target pixel electrode, and the determination module 1 may be implemented by, for example, a determination circuit, but embodiments of the present disclosure are not limited thereto. The detector module 2 is configured to detect the voltage difference between the driving voltage of the data line and the driving voltage of the target pixel electrode in the period from the start of the present charging of the target pixel electrode to the start of the next charging of the target pixel electrode. The calculator module 3 is configured to calculate the variation of the driving voltage of the target pixel electrode caused by the capacitance and the voltage difference. The compensator module 4 is configured to compensate for the driving voltage of the target pixel electrode according to the variation.

For example, in other embodiments, the pixel voltage compensator device may not include the determination module 1; in this case, the capacitance between the at least one data line and the target pixel electrode may be obtained by detection after the array substrate is manufactured, and provided to the calculator module 3 according to needs. It should be noted that, in other examples of the pixel voltage compensator device, the determination module 1 may not be included.

For example, by providing the determination module 1, the detector module 2, the calculator module 3 and the compensator module 4, the capacitance that is between the at least one data line adjacent to the target pixel electrode and the target pixel electrode and that causes the variation of the driving voltage of the target pixel electrode may be detected and determined, and the voltage difference between the driving voltage of the data line and the driving voltage of the target pixel electrode may be detected and determined; then, the variation of the driving voltage of the target pixel electrode may be calculated according to these influencing factors; and then the driving voltage of the target pixel electrode may be compensated according to the variation, so as to suppress the difference between the actual displayed brightness of different pixels displaying the same gray level, thereby suppressing the cross-talk phenomenon of the display device and improving the display effect of the display device.

Here, the compensator module 4 includes a judgment unit 41, a first compensator unit 42 and a second compensator unit 43. The judgment unit 41 is configured to determine whether the variation is greater than zero or less than zero. The first compensator unit 42 is configured to subtract the variation from the driving voltage of the target pixel electrode in the case where a determination result of the judgment unit 41 is that the variation is greater than zero. The second compensator unit 43 is configured to add the absolute value of the variation to the driving voltage of the target pixel electrode in the case where the determination result of the judgment unit 41 is that the variation is less than zero.

By providing the judgment unit 41, the first compensator unit 42 and the second compensator unit 43, it can be realized that the driving voltage of the target pixel electrode is compensated, and the compensation amount for the driving voltage of the target pixel electrode may be just equal to the amount of influence that the capacitance between the at least one data line adjacent to the target pixel electrode and the target pixel electrode and the voltage difference between the driving voltage of the data line and the driving voltage of the target pixel electrode have on the driving voltage of the target pixel electrode.

It should be noted that, those skilled in the art can clearly understand that the determination module 1, the detector module 2, the calculator module 3, the compensator module 4, the judging unit 41, the first compensator unit 42 and the second compensator unit 43 which are provided by the embodiments of the present disclosure can be implemented by means of software plus necessary general hardware or by dedicated hardware, and in many cases the former may be the preferred embodiment. Based on such understanding, the determination module 1, the detector module 2, the calculator module 3 and the compensator module 4, the judgment unit 41, the first compensator unit 42 and the second compensator unit 43 provided by the embodiments of the present disclosure are essentially implemented by software, hardware, firmware or any combination thereof, the software is stored in a readable storage medium such as a magnetic storage medium (such as a hard disk) or an electronic storage medium (such as ROM, flash memory) and the software includes a plurality of instructions for making a hardware (e.g., microprocessor or digital signal processor) achieve corresponding functions.

Figure 9:
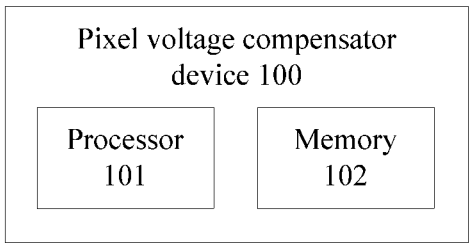
FIG. 9 is another exemplary block diagram of the pixel voltage compensator device according to an embodiment of the present disclosure.

The embodiments of the present disclosure further provide a pixel voltage compensator device 100. As illustrated in FIG. 9, the pixel voltage compensator device includes a processor 101 and a memory 102. The memory 102 stores a computer program instruction, and the computer program instruction is executed by the processor 101 to perform the step S10, the step S11, the step S12 and the step S13. For details of the step S10, the step S11, the step S12 and the step S13, refer to the pixel voltage compensation method, and details are not described herein again.

For example, the processor 101 is a central processing unit (CPU) or other form of processor unit having a data processing capability and/or an instruction execution capability, and may be implemented by an X86 configuration or an ARM configuration; for example, the processor may be a general purpose processor, or may be a single chip microcomputer, a microprocessor, a digital signal processor, a dedicated image processing chip, or a field programmable logic array. The processing apparatus of the following embodiments is similar. The memory 102 may include, for example, a volatile memory and/or a nonvolatile memory, or may include various types of storage devices or storage media such as a read only memory (ROM), a hard disk, a flash memory and the like. Accordingly, the memory may be implemented as one or more computer program products, which may include various forms of computer readable storage media, in which one or more computer program instructions may be stored. The processor may execute the computer program instructions to implement the functions of the pixel voltage compensator device. The memory may also store various other applications and various data, as well as various data and the like that are used and/or generated by the applications (for example, the variation of the driving voltage of the target pixel electrode).

Figure 5:
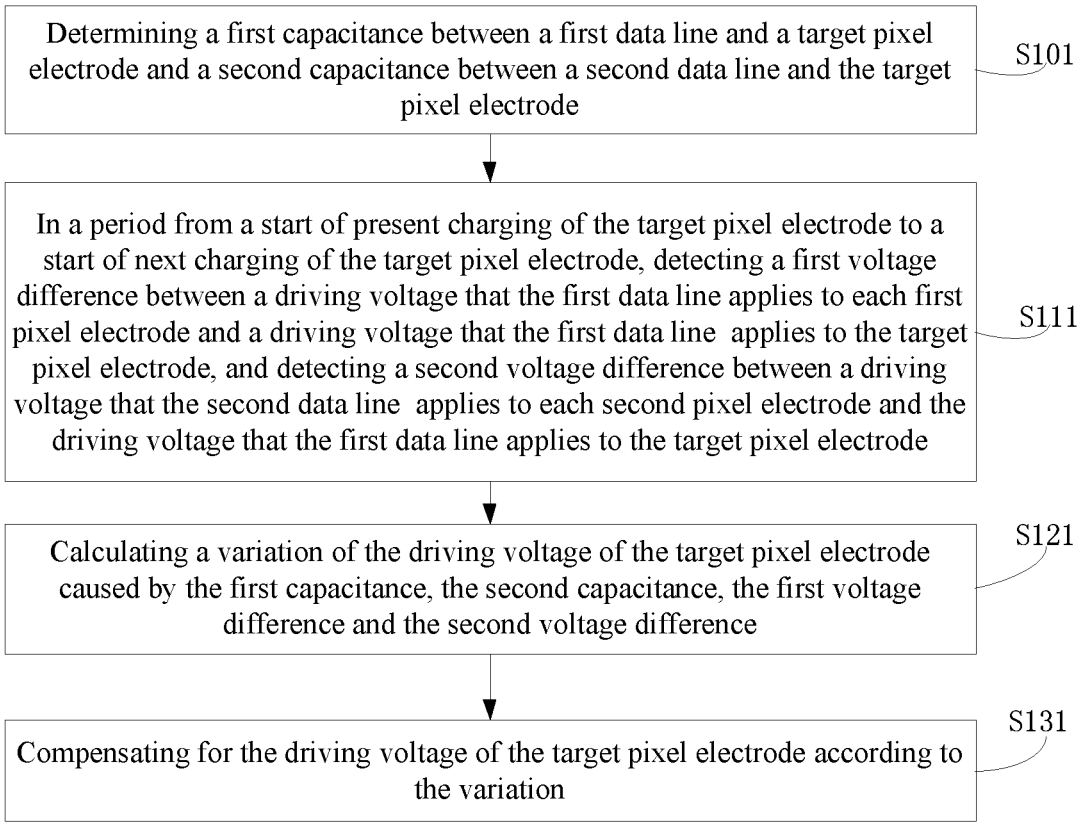
FIG. 5 is another flowchart of the pixel voltage compensation method according to an embodiment of the present disclosure.

At least one embodiment of the present disclosure provides another pixel voltage compensation method similar to the pixel voltage compensation method as illustrated in FIG. 2. In this example, the at least one data line adjacent to the target pixel electrode includes the first data line and the second data line, and the first data line and the second data line are disposed on opposite sides of the target pixel electrode; the first data line is connected through, for example, switch elements with the target pixel electrode and with at least one first pixel electrode (e.g., a plurality of first pixel electrodes) in a column provided with the target pixel electrode; the second data line is connected with a column of second pixel electrodes through, for example, switch elements, and the column of the second pixel electrodes is adjacent to the column provided with the target pixel electrode. As illustrated in FIG. 5, the pixel voltage compensation method includes the following steps.

Step S101: determining the first capacitance between the first data line and the target pixel electrode and the second capacitance between the second data line and the target pixel electrode.

It should be noted that, according to actual application requirements, the pixel voltage compensation method may not include the step S10, and the capacitance between the at least one data line and the target pixel electrode may be obtained by detection after the array substrate is manufactured, and be used for the pixel voltage compensation method.

Step S111: in the period from the start of the present charging of the target pixel electrode to the start of the next charging of the target pixel electrode, detecting a first voltage difference between a driving voltage applied to each first pixel electrode by the first data line and a driving voltage applied to the target pixel electrode by the first data line, and detecting a second voltage difference between a driving voltage applied to each second pixel electrode by the second data line and the driving voltage applied to the target pixel electrode by the first data line.

For example, the detecting of the first voltage difference between the driving voltage applied to each first pixel electrode by the first data line and the driving voltage applied to the target pixel electrode by the first data line may include: obtaining the first voltage differences between the driving voltages, in the charging period of the target pixel electrode, of the first data line and the driving voltage of the target pixel electrode; the detecting of the second voltage difference between the driving voltage applied to each second pixel electrode by the second data line and the driving voltage applied to the target pixel electrode by the first data line may include: obtaining the second voltage differences between the driving voltages, in the charging period of the target pixel electrode, of the second data line (that is the driving voltages that the second data line applies to the second electrodes) and the driving voltage of the target pixel electrode.

It should be noted that the time when the step S111 is performed is not limited to being in the charging period of the target pixel electrode (that is, the period from the start of the present charging of the target pixel electrode to the start of the next charging of the target pixel electrode); according to actual application requirements, the step S111 may be performed within the blanking time between adjacent display frames, or the step S111 may be performed after the source of the images is obtained and before the images are displayed. It should be noted that, in other examples of the pixel voltage compensation method, the time for acquiring the first voltage difference or/and the second voltage difference is also not limited to being in the charging period of the target pixel electrode.

In the embodiments of the present disclosure, the compensation for the pixel voltage of the target pixel electrode mainly involves to take the following influences into consideration: the influences that the first capacitance, the second capacitance, the first voltage differences and the second voltage differences have on the pixel voltage of the target pixel electrode in one frame of displayed image period.

Step S121: calculating the variation of the driving voltage of the target pixel electrode caused by the first capacitance, the second capacitance, the first voltage differences and the second voltage differences.

In this step, in the period from the start of the present charging of the target pixel electrode to the start of the next charging of the target pixel electrode, the first data line drives n−1 first pixel electrodes, the second data line drives n second pixel electrodes, in which n>1, and n is an integer. The variation of the driving voltage of the target pixel electrode caused by the first capacitance, the second capacitance, the first voltage differences and the second voltage differences may be calculated by the following formula.

$$\Delta V=\{Cdp1*[\Delta V11*T11+\Delta V12*T12+ \ldots + \Delta V1(n-1)*T1(n-1)]/Ts+Cdp2*[\Delta V21*T21+\Delta V22*T22+ \ldots +\Delta V2(n-1)*T2(n-1)+\Delta V2n*T2n]/Ts\}/Cpixel,$$

which is referred to as formula (1) in the following.

In the above formula, Cdp1 is the first capacitance; Cdp2 is the second capacitance; ΔV1(n−1) is the first voltage difference between the driving voltage that the first data line applies to the (n−1)th first pixel electrode in the charging period of the target pixel electrode and the driving voltage applied to the target pixel electrode by the first data line; ΔV2n is the second voltage difference between the driving voltage that the second data line applies to the nth second pixel electrode in the charging period of the target pixel electrode and the driving voltage applied to the target pixel electrode by the first data line; T1(n−1) is the driving time of the (n−1)th first pixel electrode; T2n is the driving time of the nth second pixel electrode; Ts is the time of one frame of displayed image; Cpixel is the total capacitance of the target pixel electrode. In the embodiments of the present disclosure, the total capacitance of the target pixel electrode is the storage capacitance of the target pixel electrode.

It should be noted that, the total capacitance of the target pixel electrode, the first capacitance and the second capacitance are determined by the manufacturing process of the array substrate. After the array substrate is manufactured, values of the total capacitance of the target pixel electrode, the first capacitance and the second capacitance are determined accordingly. Therefore, in other examples, the total capacitance of the pixel electrode, the first capacitance and the second capacitance may be obtained by detection after the array substrate is manufactured and may be used in the calculation of the variation of the driving voltage of the target pixel electrode. The first voltage difference is determined by the driving voltage that the first data line applies to the n−1 first pixel electrodes. The second voltage difference is determined by the driving voltage that the second data line applies to the n second pixel electrodes.

For example, the variation of the driving voltage of the target pixel electrode caused by the first capacitance, the second capacitance, the first voltage differences and the second voltage differences may also be obtained based on the first variation of the driving voltage of the target pixel electrode caused by the first voltage differences and the first capacitance and the second variation of the driving voltage of the target pixel electrode caused by the second voltage differences and the second capacitance.

In addition, the driving time of each first pixel electrode, the driving time of each second pixel electrode and the driving time of the target pixel electrode may be the same, thereby reducing the work load of calculating the variation, the first variation and the second variation of the driving voltage of the target pixel electrode.

It should be noted that, the driving time of the pixel electrode in the embodiments of the present disclosure is the duration of a data signal, which is corresponding to the pixel electrode, of the data line; and because the pixel electrode is related to a storage electrode, a retention time (for example, the period of the pixel electrode) of the data signal applied on the pixel electrode is longer than the duration of the data signal, which is corresponding to the pixel electrode, of the data line.

Figure 6:
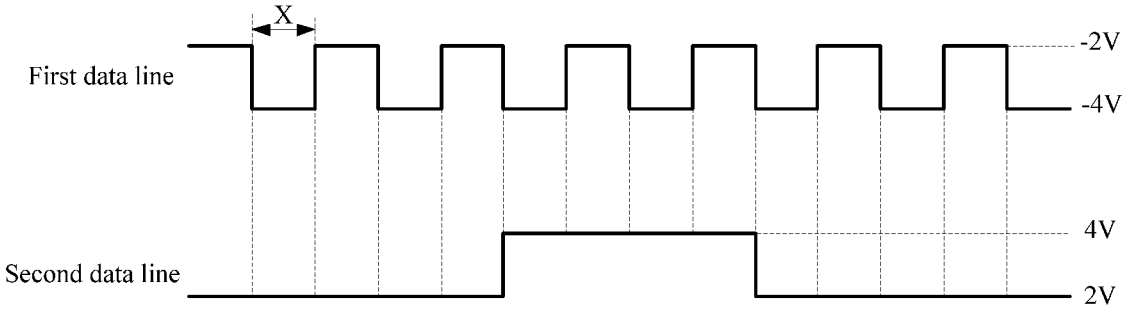
FIG. 6 is a schematic diagram of waveforms and driving voltages of a first data line and a second data line in an embodiment of the present disclosure.

FIG. 6 illustrates a kind of a driving voltage signal of the first data line and the second data line in the charging period of the target pixel electrode, but embodiments of the present disclosure are not limited thereto. For example, it is assumed that the driving voltage signals of the first data line and the second data line are as illustrated in FIG. 6, that is, it is assumed that a total of 14 rows of pixel electrodes are disposed on the display panel, and the target pixel electrode is one of the first row of pixel electrodes. The driving voltage applied to the target pixel electrode by the first data line is −2V, the driving voltage that the first data line applies to other seven first pixel electrodes in the same column as the target pixel electrode is −4V, and the driving voltage that the first data line applies to another six first pixel electrodes in the same column as the target pixel electrode is −2V. It is assumed that the driving voltage that the second data line applies to ten of the second pixel electrodes is 2V, and the driving voltage that the second data line applies to four of the second pixel electrodes is 4V. It is assumed that the first capacitance is 3 F (farad), the second capacitance is 2 F, and the total capacitance of the target pixel electrode is 100 F.

For example, a calculation method of the variation of the driving voltage of the target pixel electrode will be exemplarily described below with reference to FIG. 6, and the embodiments of the present disclosure are not limited thereto.

For example, an average in time of the first voltage differences may be calculated by the following expression: $[\Delta V11+\Delta V12+ \ldots +\Delta V1(n-1)]*(T1/Ts)=7X(-4+2)/14X=-1V$, in which the average in time of the first voltage difference in the calculation formula (i.e., the formula (1)) of the variation of the driving voltage of the target pixel electrode is caused by the first data line.

For example, an average in time of the second voltage differences may be calculated by the following expression: $[\Delta V21+\Delta V22+ \ldots +\Delta V2(n-1)+\Delta V2n]*(T1/Ts)=[10X(2+2)+4X(4+2)]/14X=4.571V$, in which the average in time of the second voltage difference in the calculation formula of the variation of the driving voltage of the target pixel electrode (i.e., the formula (1)) is caused by the second data line.

For example, the variation of the driving voltage of the target pixel electrode may be calculated by the following expression: $\Delta V=[3*(-1)+2*4.571]/100=0.06142V$.

It should be noted that, in other embodiments, the first voltage differences $\Delta V1(n-1)$ may be equal to the differences between the driving voltages that the first data line applies to (n−1)th first pixel electrodes in the charging period of the target pixel electrode and the driving voltage applied to the target pixel electrode by the first data line; and the second voltage differences $\Delta V2n$ may be equal to the differences between the driving voltages that the second data line applies to nth second pixel electrodes in the charging period of the target pixel electrode and an initial driving voltage of the second data line at an initial moment of the charging period. For example, the calculation method of the variation of the driving voltage of the target pixel electrode will be exemplarily described below with reference to FIG. 6.

For example, the average in time of the first voltage differences caused by the first data line may be calculated by the following expression: $[\Delta V11+\Delta V12+\ldots+\Delta V1(n-1)]*(T1/Ts)=7X(-4+2)/14X=-1V$.

For example, the average in time of the second voltage differences caused by the second data line may be calculated by the following expression: $[\Delta V21+\Delta V22+\ldots+\Delta V2(n-1)+\Delta V2n]*(T1/Ts)=[10X(2-2)+4X(4-2)]/14X=0.5714V$.

For example, the variation of the driving voltage of the target pixel electrode may be calculated by the following expression: $\Delta V=[3*(-1)+2*0.5714]/100=-0.0186V$.

It should be noted that the calculation method of the variation of the driving voltage of the target pixel electrode may be selected according to actual application requirements. For example, in the case where the display panel or the display device adopts a driving manner of row inversion, the above first type calculation method of the variation of the driving voltage of the pixel electrode described above may be employed; in the case where the display panel or the display device adopts the driving manner of column inversion or the driving manner of dot inversion, the above second type calculation method of the variation of the driving voltage of the pixel electrode described above may be employed.

Step S131: compensating for the driving voltage of the target pixel electrode according to the variation.

For a specific method for compensating for the driving voltage of the target pixel electrode according to the variation, refer to the step S13 of the embodiment as illustrated in FIG. 2, and details are not described herein again.

For example, in the case where the first type calculation method of the variation of the driving voltage of the pixel electrode is used, because $\Delta V=0.06142V>0$, the variation $\Delta V$ is subtracted from a reference driving voltage Vp of the target pixel electrode to obtain the compensated driving voltage $Vp-\Delta V$ of the target pixel electrode, and thereby the compensation for the driving voltage of the target pixel electrode can be achieved.

For example, in the case where the above second type calculation method of the variation of the driving voltage of the pixel electrode is used, because $\Delta V=-0.0186V<0$, the absolute value $1\Delta V1$ of the variation is added to the reference driving voltage Vp of the target pixel electrode to obtain $Vp+1\Delta V1$, so as to obtain the compensated driving voltage $Vp+1\Delta V1$ of the target pixel electrode, and thereby the compensation for the driving voltage of the target pixel electrode can be realized.

Based on the pixel voltage compensation method provided by the embodiments of the present disclosure, the embodiments of the present disclosure further provide a pixel voltage compensator device, and the pixel voltage compensator device may include a determination module, a detector module, a calculator module and a compensator module. The determination module is configured to determine the first capacitance between the first data line and the target pixel electrode, and to determine the second capacitance between the second data line and the target pixel electrode. The detector module is configured to detect the first voltage difference between the driving voltage applied to each first pixel electrode by the first data line and the driving voltage applied to the target pixel electrode by the first data line, and to detect the second voltage difference between the driving voltage applied to each second pixel electrode by the second data line and the driving voltage applied to the target pixel electrode by the first data line, in the period from the start of the present charging of the target pixel electrode to the start of the next charging of the target pixel electrode. The calculator module is configured to calculate the variation of the driving voltage of the target pixel electrode caused by the first capacitance, the second capacitance, the first voltage differences and the second voltage differences. For the specific implementation of the modules of the pixel voltage compensator device, reference may be made to the embodiment as illustrated in FIG. 4, and details are not described herein again.

It should be noted that, according to actual application requirements, the pixel voltage compensator device may not include the determination module 1; in this case, the first capacitance between the first data line and the target pixel electrode and the second capacitance between the second data line and the target pixel electrode may be obtained by detection after the array substrate is manufactured, and may be supplied to the calculator module 3 as needed.

It should be noted that, the time when the detector module obtains the first voltage difference and the second voltage difference is not limited to being in the charging period of the target pixel electrode (that is, the period from the start of the present charging of the target pixel electrode to the start of the next charging of the target pixel electrode); according to actual application requirements, the detector module may obtain the first voltage difference and the second voltage difference within the blanking time between adjacent display frames, or after the source of the images is obtained and before the images are displayed.

Figure 10:
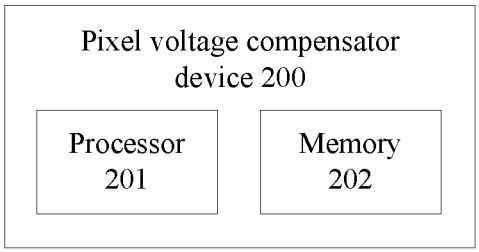
FIG. 10 is still another exemplary block diagram of the pixel voltage compensator device according to an embodiment of the present disclosure.

The embodiments of the present disclosure further provide a pixel voltage compensator device 200. As illustrated in FIG. 10, the pixel voltage compensator device includes a processor 201 and a memory 202. The memory 202 stores a computer program instruction, and the computer program instruction is executed by the processor 201 to perform the steps below.

Step S211: obtaining the first voltage differences between the driving voltages, in the charging period of the target pixel electrode, of the first data line connected with the target pixel electrode and the driving voltage of the target pixel electrode, and obtaining the second voltage differences between the driving voltages, in the charging period, of the second data line adjacent to the target pixel electrode and the initial driving voltage of the second data line at the initial moment of the charging period.

In the step S211, the charging period is the period from the start of the present charging of the target pixel electrode to the start of the next charging of the target pixel electrode; the first data line and the second data line are disposed on opposite sides of the target pixel electrode.

Step S221: calculating the first variation of the driving voltage of the target pixel electrode caused by the first voltage differences and the first capacitance, and calculating the second variation of the driving voltage of the target pixel electrode caused by the second voltage differences and the second capacitance.

In step S221, the first capacitance is the capacitance between the target pixel electrode and the first data line, and the second capacitance is the capacitance between the target pixel electrode and the second data line.

Step S231: compensating for the driving voltage of the target pixel electrode according to at least the first variation and the second variation.

For example, in the step S231, the variation of the driving voltage of the target pixel electrode may be obtained according to the total capacitance of the target pixel electrode, the first variation and the second variation, and the driving voltage of the target pixel electrode may be compensated according to the variation of the driving voltage of the target pixel electrode. For a specific method for the compensating for the driving voltage of the target pixel electrode according to the variation of the driving voltage of the target pixel electrode, for example, reference may be made to the embodiment as illustrated in FIG. 3, and details are not described herein. For example, the specific implementation of the processor 201 and the memory 202 may be referred to the processor 101 and the memory 102, and details are not described herein.

Figure 7:
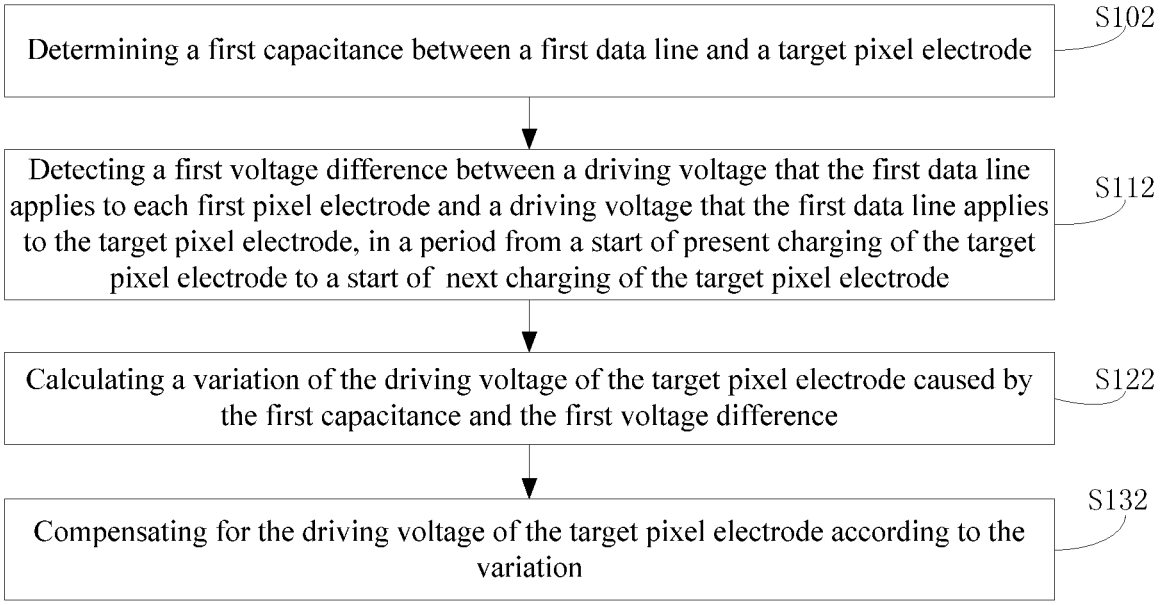
FIG. 7 is still another flowchart of the pixel voltage compensation method according to an embodiment of the present disclosure.

At least one embodiment of the present disclosure provides still another pixel voltage compensation method similar to the pixel voltage compensation method as illustrated in FIG. 2. In this example, the at least one data line adjacent to the target pixel electrode includes the first data line, and the first data line is connected through, for example, switch elements with the target pixel electrode and with the first pixel electrodes in the column provided with the target pixel electrode. As illustrated in FIG. 7, the pixel voltage compensation method includes the following steps.

Step S102: determining the first capacitance between the first data line and the target pixel electrode.

Step S112: detecting the first voltage difference between the driving voltage applied to each first pixel electrode by the first data line and the driving voltage applied to the target pixel electrode by the first data line, in the period from the start of the present charging of the target pixel electrode to the start of the next charging of the target pixel electrode.

Step S122: calculating the variation of the driving voltage of the target pixel electrode caused by the first capacitance and the first voltage differences.

In this step, in the period from the start of the present charging of the target pixel electrode to the start of the next charging of the target pixel electrode, the first data line drives (n−1) the first pixel electrodes, in which n>1, and n is an integer. The variation of the driving voltage of the target pixel electrode caused by the first capacitance and the first voltage differences: $\Delta V=\{Cdp1*[\Delta V11*T11+\Delta V12*T12+\ldots+\Delta V1(n-1)*T1(n-1)]/Ts\}/Cpixel$.

In the above expression, Cdp1 is the first capacitance; $\Delta V1(n-1)$ is the first voltage difference between the driving voltage that the first data line applies to the (n−1)th first pixel electrode and the driving voltage applied to the target pixel electrode by the first data line; T1(n−1) is the driving time of the (n−1)th first pixel electrode; Ts is the time of one frame of displayed image; Cpixel is the total capacitance of the target pixel electrode.

Step S132: compensating for the driving voltage of the target pixel electrode according to the variation.

For a specific method for the compensating for the driving voltage of the target pixel electrode according to the variation, refer to the step S13 of the embodiment as illustrated in FIG. 2, and details are not described herein again.

Based on the pixel voltage compensation method provided by the embodiments of the present disclosure, the embodiments of the present disclosure further provide a pixel voltage compensator device which includes a determination module, a detector module, a calculator module and a compensator module. The determination module is configured to determine the first capacitance between the first data line and the target pixel electrode. The detector module is configured to detect the first voltage differences between the driving voltages that the first data line applies to the first pixel electrodes and the driving voltage applied to the target pixel electrode by the first data line, in the period from the start of the present charging of the target pixel electrode to the start of the next charging of the target pixel electrode. The calculator module is configured to calculate the variation of the driving voltage of the target pixel electrode caused by the first capacitance and the first voltage differences. For the specific implementation of the modules of the pixel voltage compensator device, reference may be made to the embodiment as illustrated in FIG. 4, and details are not described herein again.

Figure 8:
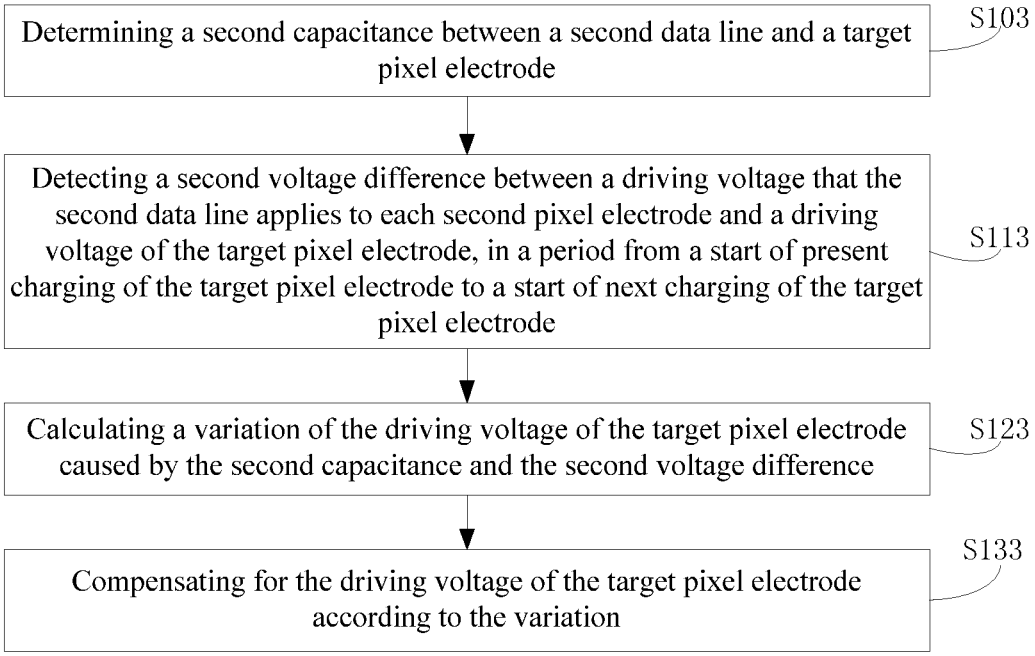
FIG. 8 is still another flowchart of the pixel voltage compensation method according to an embodiment of the present disclosure.

At least one embodiment of the present disclosure provides yet another pixel voltage compensation method similar to the pixel voltage compensation method as illustrated in FIG. 2. In this example, the at least one data line adjacent to the target pixel electrode includes a second data line, and the second data line is connected with the column of second pixel electrodes through switch elements, and the column of the second pixel electrodes is adjacent to the column provided with the target pixel electrode. As illustrated in FIG. 8, the pixel voltage compensation method includes the following steps.

Step S103: determining the second capacitance between the second data line and the target pixel electrode.

Step S113: detecting the second voltage differences between the driving voltages that the second data line applies to the second pixel electrodes and the driving voltage of the target pixel electrode, in the period from the start of the present charging of the target pixel electrode to the start of the next charging of the target pixel electrode.

Step S123: calculating the variation of the driving voltage of the target pixel electrode caused by the second capacitance and the second voltage differences.

In this step, the second data line drives n second pixel electrodes during the period from the start of the present charging of the target pixel electrode to the start of the next charging of the target pixel electrode; in which n>1 and n is an integer. The variation of the driving voltage of the target pixel electrode caused by the second capacitance and the second voltage differences: $\Delta V=\{Cdp2*[\Delta V21*T21+\Delta V22*T22+\ldots+\Delta V2(n-1)*T2(n-1)+\Delta V2n*T2n]/Ts\}/Cpixel$.

In the above expression, Cdp2 is the second capacitance; $\Delta V2n$ is the second voltage difference between the driving voltage that the second data line applies to the nth second pixel electrode and the driving voltage of the target pixel electrode; T2n is the driving time of the nth second pixel electrode; Ts is the time of one frame of displayed image; Cpixel is the total capacitance of the target pixel electrode.

Step S133: compensating for the driving voltage of the target pixel electrode according to the variation.

For a specific method for the compensating for the driving voltage of the target pixel electrode according to the variation, refer to the step S13 of the embodiment as illustrated in FIG. 2, and details are not described herein again.

Based on the pixel voltage compensation method provided by the embodiments of the present disclosure, the embodiments of the present disclosure further provides a pixel voltage compensator device, and the pixel voltage compensator device may include a determination module, a detector module, a calculator module and a compensator module. The determination module is configured to determine the second capacitance between the second data line and the target pixel electrode. The detector module is configured to detect the second voltage differences between the driving voltages that the second data line applies to the second pixel electrodes and the driving voltage of the target pixel electrode, in the period from the start of the present charging of the target pixel electrode to the start of the next charging of the target pixel electrode. The calculator module is configured to calculate the variation of the driving voltage of the target pixel electrode caused by the second capacitance and the second voltage differences. For the specific implementation of the modules of the pixel voltage compensator device, reference may be made to the embodiment as illustrated in FIG. 4, and details are not described herein again.

The embodiments of the present disclosure provide the pixel voltage compensation method and the pixel voltage compensator device. In some examples, by detecting and determining the capacitance that is between the at least one data line adjacent to the target pixel electrode and the target pixel electrode and that causes the variation of the driving voltage of the target pixel electrode, and by detecting and determining the voltage difference between the driving voltages of the data line and the driving voltage of the target pixel electrode, the variation of the driving voltage of the target pixel electrode is calculated according to these influencing factors; and then the driving voltage of the target pixel electrode is compensated according to the variation, so as to suppress the difference between the actual displayed brightness of different pixels displaying the same gray level, thereby suppressing the cross-talk phenomenon of the display device and improving the display effect of the display device. In other examples, the voltage differences between the driving voltages of the at least one data line (e.g., the first data line) adjacent to the target pixel electrode and the driving voltage of the target pixel electrode may be obtained, the variation of the driving voltage of the target pixel electrode is calculated according to the above voltage differences and the capacitance between the at least one data line adjacent to the target pixel electrode and the target pixel electrode, and then the driving voltage of the target pixel electrode is compensated according to the variation to improve the display effect of the display device.

Figure 11:
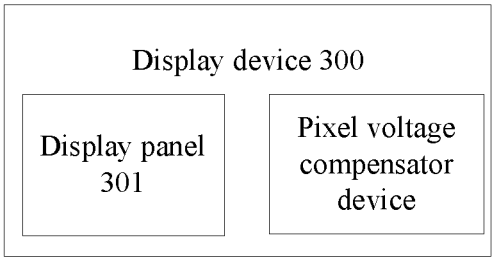
FIG. 11 is an exemplary block diagram of a display device provided by an embodiment of the present disclosure.

At least one embodiment of the present disclosure further provides a display device 300, as illustrated in FIG. 11, the display device 300 includes a display panel 301 and the pixel voltage compensator device provided by any one of the embodiments of the present disclosure. By adopting the pixel voltage compensator device provided by any embodiment of the present disclosure, the cross-talk phenomenon of the display device is suppressed, and the display effect of the display device is improved.

The display panel provided by the present disclosure may be any product or component having a display function, such as a mobile phone, a tablet computer, a television, a display, a notebook computer, a digital photo frame, a navigator, and the like.

It should be noted that, those skilled in the art understand that the display device 300 may also have other essential components (e.g., control devices, image data encoding/decoding devices, row scan drivers, column scan drivers, clock circuits, etc.), which is not described and not limitative to the embodiments of the present disclosure.

It is apparent to those skilled in the art to make various modifications, variations and combinations to the embodiments of the present disclosure without departing from the spirit and scope of the present disclosure. In this way, if these modifications, variations and combinations belong to the scope of the claims of the present disclosure and their equivalents, then the present disclosure is intended to cover these modifications and variations.

What are described above is related to the illustrative embodiments of the disclosure only and not limitative to the scope of the disclosure; the scopes of the disclosure are defined by the accompanying claims.

What is claimed is:

1. A pixel voltage compensation method, comprising:

determining a capacitance between at least one data line adjacent to a target pixel electrode and the target pixel electrode;

detecting a voltage difference between a driving voltage of the data line and a driving voltage of the target pixel electrode in a period from a start of present charging of the target pixel electrode to a start of next charging of the target pixel electrode;

calculating a variation of the driving voltage of the target pixel electrode caused by the capacitance and the voltage difference; and compensating for the driving voltage of the target pixel electrode according to the variation;

wherein the compensating for the driving voltage of the target pixel electrode according to the variation comprises:

determining whether the variation is greater than zero or less than zero;

in a case where the variation is greater than zero, subtracting the variation from the driving voltage of the target pixel electrode; and in a case where the variation is less than zero, adding an absolute value of the variation to the driving voltage of the target pixel electrode.

2. The pixel voltage compensation method according to claim 1, wherein the at least one data line adjacent to the target pixel electrode comprises a first data line, and the first data line is selectively connected with the target pixel electrode and with first pixel electrodes which are in a column provided with the target pixel electrode;

the pixel voltage compensation method comprises:

determining a first capacitance between the first data line and the target pixel electrode;

detecting a first voltage difference between a driving voltage applied to each of the first pixel electrodes by the first data line and a driving voltage applied to the target pixel electrode by the first data line, in the period from the start of the present charging of the target pixel electrode to the start of the next charging of the target pixel electrode;

calculating the variation of the driving voltage of the target pixel electrode caused by the first capacitance and the first voltage difference; and compensating for the driving voltage of the target pixel electrode according to the variation.

3. The pixel voltage compensation method according to claim 2, wherein in the period from the start of the present charging of the target pixel electrode to the start of the next charging of the target pixel electrode, the first data line drives n−1 first pixel electrodes, wherein n>1, and n is an integer;

the variation ΔV of the driving voltage of the target pixel electrode caused by the first capacitance and the first voltage difference is calculated by a following expression:

$$\Delta V=\{Cdp1*[\Delta V11*T11+\Delta V12*T12+\ldots+\Delta V1(n-1)*T1(n-1)]/Ts\}/\text{Cpixel},$$

wherein Cdp1 is the first capacitance; ΔV1(n−1) is a first voltage difference between a driving voltage applied to an (n−1)th first pixel electrode by the first data line and the driving voltage applied to the target pixel electrode by the first data line; T1(n−1) is driving time of the (n−1)th first pixel electrode; Ts is time of one frame of displayed image; Cpixel is a total capacitance of the target pixel electrode; ΔV11 is a first voltage difference between a driving voltage applied to a first first pixel electrode by the first data line and the driving voltage applied to the target pixel electrode by the first data line; ΔV12 is a first voltage difference between a driving voltage applied to a second first pixel electrode by the first data line and the driving voltage applied to the target pixel electrode by the first data line; T11 is driving time of the first first pixel electrode; T12 is driving time of the second first pixel electrode.

4. The pixel voltage compensation method according to claim 3, wherein the total capacitance of the target pixel electrode is a storage capacitance of the target pixel electrode.

5. The pixel voltage compensation method according to claim 1, wherein the at least one data line adjacent to the target pixel electrode comprises a second data line, the second data line is selectively connected with a column of second pixel electrodes, and the column of the second pixel electrodes is adjacent to a column provided with the target pixel electrode;

the pixel voltage compensation method comprises:

determining a second capacitance between the second data line and the target pixel electrode;

detecting a second voltage difference between a driving voltage applied to each of the second pixel electrodes by the second data line and the driving voltage of the target pixel electrode in the period from the start of the present charging of the target pixel electrode to the start of the next charging of the target pixel electrode;

calculating the variation of the driving voltage of the target pixel electrode caused by the second capacitance and the second voltage difference; and compensating for the driving voltage of the target pixel electrode according to the variation.

6. The pixel voltage compensation method according to claim 5, wherein the second data line drives n second pixel electrodes in the period from the start of the present charging of the target pixel electrode to the start of the next charging of the target pixel electrode, wherein n>1 and n is an integer;

the variation ΔV of the driving voltage of the target pixel electrode caused by the second capacitance and the second voltage difference is calculated by a following expression:

$$\Delta V=\{Cdp2*[\Delta V21*T21+\Delta V22*T22+\ldots+\Delta V2(n-2)*T2(n-1)+\Delta V2n*T2n]/Ts\}/\text{Cpixel},$$

wherein Cdp2 is the second capacitance; ΔV2n is a second voltage difference between a driving voltage applied to a nth second pixel electrode by the second data line and the driving voltage of the target pixel electrode; T2n is driving time of the nth second pixel electrode; Ts is time of one frame of displayed image; Cpixel is a total capacitance of the target pixel electrode; ΔV21 is a second voltage difference between a driving voltage applied to a first second pixel electrode by the second data line and the driving voltage of the target pixel electrode; ΔV22 is a second voltage difference between a driving voltage applied to a second second pixel electrode by the second data line and the driving voltage of the target pixel electrode; ΔV2(n−1) is a second voltage difference between a driving voltage applied to a (n−1)th second pixel electrode by the second data line and the driving voltage of the target pixel electrode; T21 is driving time of the first second pixel electrode; T22 is driving time of the second second pixel electrode; T2(n−1) is driving time of the (n−1)th second pixel electrode.

7. The pixel voltage compensation method according to claim 1, wherein the at least one data line adjacent to the target pixel electrode comprises a first data line and a second data line, the first data line is selectively connected with the target pixel electrode and with first pixel electrodes in a column provided with the target pixel electrode; the second data line is selectively connected with a column of second pixel electrodes, and the column of the second pixel electrodes is adjacent to the column provided with the target pixel electrode;

the pixel voltage compensation method comprises:

determining a first capacitance between the first data line and the target pixel electrode, and determining a second capacitance between the second data line and the target pixel electrode;

in the period from the start of the present charging of the target pixel electrode to the start of the next charging of the target pixel electrode, detecting a first voltage difference between a driving voltage applied to each of the first pixel electrodes by the first data line and a driving voltage applied to the target pixel electrode by the first data line, and detecting a second voltage difference between a driving voltage applied to each of the second pixel electrodes by the second data line and the driving voltage applied to the target pixel electrode by the first data line;

calculating the variation of the driving voltage of the target pixel electrode caused by the first capacitance, the second capacitance, the first voltage difference and the second voltage difference; and compensating for the driving voltage of the target pixel electrode according to the variation.

8. The pixel voltage compensation method according to claim 7, wherein in the period from the start of the present charging of the target pixel electrode to the start of the next charging of the target pixel electrode, the first data line drives n−1 first pixel electrodes, the second data line drives n second pixel electrodes, wherein n>1, and n is an integer;

the variation ΔV of the driving voltage of the target pixel electrode caused by the first capacitance, the second capacitance, the first voltage difference and the second voltage difference is calculated by a following expression:

$$\Delta V=\{Cdp1*[\Delta V11*T11+\Delta V12*T12+\ldots+\Delta V1(n-1)*T1(n-1)]/Ts+Cdp2*[\Delta V21*T21+\Delta V22*T22+\ldots+\Delta V2(n-1)*T2(n-1)+\Delta V2n*T2n]/Ts\}/\text{Cpixel},$$

wherein Cdp1 is the first capacitance; Cdp2 is the second capacitance; ΔV1(n−1) is a first voltage difference between a driving voltage applied to an (n−1)th first pixel electrode by the first data line and the driving voltage applied to the target pixel electrode by the first data line; ΔV2n is a second voltage difference between a driving voltage applied to a nth second pixel electrode by the second data line and the driving voltage applied to the target pixel electrode by the first data line; T1(n−1) is driving time of the (n−1)th first pixel electrode; T2n is driving time of the nth second pixel electrode; Ts is time of one frame of displayed image; Cpixel is a total capacitance of the target pixel electrode; ΔV11 is a first voltage difference between a driving voltage applied to a first first pixel electrode by the first data line and the driving voltage applied to the target pixel electrode by the first data line; ΔV12 is a first voltage difference between a driving voltage applied to a second first pixel electrode by the first data line and the driving voltage applied to the target pixel electrode by the first data line; T11 is driving time of the first first pixel electrode; T12 is driving time of the second first pixel electrode; ΔV21 is a second voltage difference between a driving voltage applied to a first second pixel electrode by the second data line and the driving voltage of the target pixel electrode; ΔV22 is a second voltage difference between a driving voltage applied to a second second pixel electrode by the second data line and the driving voltage of the target pixel electrode; ΔV2(n−1) is a second voltage difference between a driving voltage applied to a (n−1)th second pixel electrode by the second data line and the driving voltage of the target pixel electrode; T21 is driving time of the first second pixel electrode; T22 is driving time of the second second pixel electrode; T2(n−1) is driving time of the (n−1)th second pixel electrode.

9. The pixel voltage compensation method according to claim 1, wherein the pixel voltage adopts an inversion manner of column inversion or an inversion manner of dot inversion during a displaying of images.

10. A pixel voltage compensation method, comprising:

obtaining a first voltage difference between a driving voltage, in a charging period of a target pixel electrode, of a first data line connected with the target pixel electrode and a driving voltage of the target pixel electrode, wherein the charging period of the target pixel electrode is a period of time from a start of present charging of the target pixel electrode to a start of next charging of the target pixel electrode;

calculating a first variation of the driving voltage of the target pixel electrode caused by the first voltage difference and a first capacitance, wherein the first capacitance is a capacitance between the target pixel electrode and the first data line; and compensating for the driving voltage of the target pixel electrode at least according to the first variation;

wherein the compensating for the driving voltage of the target pixel electrode at least according to the first variation comprises:

determining whether the first variation is greater than zero or less than zero;

in a case where the first variation is greater than zero, subtracting the first variation from the driving voltage of the target pixel electrode; and in a case where the first variation is less than zero, adding an absolute value of the first variation to the driving voltage of the target pixel electrode.

11. The pixel voltage compensation method of claim 10, further comprising:

obtaining a second voltage difference between a driving voltage, in the charging period, of a second data line adjacent to the target pixel electrode and an initial driving voltage of the second data line at an initial moment of the charging period, wherein the first data line and the second data line are on opposite sides of the target pixel electrode;

calculating a second variation of the driving voltage of the target pixel electrode caused by the second voltage difference and a second capacitance, wherein the second capacitance is a capacitance between the target pixel electrode and the second data line; and compensating for the driving voltage of the target pixel electrode according to at least the first variation and the second variation.

12. The pixel voltage compensation method according to claim 11, wherein in the charging period of the target pixel electrode, the first data line drives the target pixel electrode and n−1 first pixel electrodes, and the second data line drives n second pixel electrodes; wherein n>1, and n is an integer;

a variation of the driving voltage of the target pixel electrode caused by the first capacitance, the second capacitance, the first voltage difference and the second voltage difference is calculated by a following expression:

$$\Delta V=\{Cdp1*[\Delta V11*T11+\Delta V12*T12++\Delta V1(n-1)*T1(n-1)]/Ts+Cdp2*[\Delta V21*T21+\Delta V22*T22+\ldots+\Delta V2(n-1)*T2(n-1)+\Delta V2n*T2n]/Ts\}/Cpixel,$$

wherein Cdp1 is the first capacitance; Cdp2 is the second capacitance; ΔV1(n−1) is a first voltage difference between a driving voltage applied to an (n−1)th first pixel electrode by the first data line and a driving voltage applied to the target pixel electrode by the first data line; ΔV2n is a second voltage difference between a driving voltage applied to a nth second pixel electrode by the second data line and the initial driving voltage; T1(n−1) is driving time of the (n−1)th first pixel electrode; T2n is driving time of the nth second pixel electrode; Ts is time of one frame of displayed image; Cpixel is a total capacitance of the target pixel electrode; ΔV11 is a first voltage difference between a driving voltage applied to a first first pixel electrode by the first data line and the driving voltage applied to the target pixel electrode by the first data line; ΔV12 is a first voltage difference between a driving voltage applied to a second first pixel electrode by the first data line and the driving voltage applied to the target pixel electrode by the first data line; T11 is driving time of the first first pixel electrode; T12 is driving time of the second first pixel electrode; ΔV21 is a second voltage difference between a driving voltage applied to a first second pixel electrode by the second data line and the driving voltage of the target pixel electrode; ΔV22 is a second voltage difference between a driving voltage applied to a second second pixel electrode by the second data line and the driving voltage of the target pixel electrode; ΔV2(n−1) is a second voltage difference between a driving voltage applied to a (n−1)th second pixel electrode by the second data line and the driving voltage of the target pixel electrode; T21 is driving time of the first second pixel electrode; T22 is driving time of the second second pixel electrode; T2(n−1) is driving time of the (n−1)th second pixel electrode.

13. A pixel voltage compensator device, comprising a processor and a memory, wherein the memory stores a computer program instruction that is executed by the processor to perform the pixel voltage compensation method according to claim 10.

* * * * *